United States Patent [19]

Dinter

[11] Patent Number: 4,839,517

[45] Date of Patent: Jun. 13, 1989

[54] ROLL ELECTRODE AND DEVICE FOR PRETREATING THE SURFACES OF FILM WEBS BY MEANS OF ELECTRICAL CORONA DISCHARGE

[75] Inventor: Peter Dinter, Hallgarten, Fed. Rep. of Germany

[73] Assignee: Hoechst Aktiengesellschaft, Frankfurt am Main, Fed. Rep. of Germany

[21] Appl. No.: 126,497

[22] Filed: Nov. 30, 1987

[30] Foreign Application Priority Data

Dec. 2, 1986 [DE] Fed. Rep. of Germany ..... 3641169

[51] Int. Cl.[4] ..... H01T 19/04

[52] U.S. Cl. ..... 250/325; 250/324

[58] Field of Search ..... 250/324, 325, 326; 422/186.05; 361/229, 230

[56] References Cited

U.S. PATENT DOCUMENTS

| | | | |
|---|---|---|---|
| 4,024,038 | 5/1977 | Luc | 422/186.05 |
| 4,153,560 | 5/1979 | Dinter et al. | 422/186.05 |
| 4,239,973 | 12/1980 | Kolbe et al. | 250/325 |
| 4,281,247 | 7/1981 | Schuster | 250/325 |
| 4,514,781 | 4/1985 | Plasschaert et al. | 250/325 |

FOREIGN PATENT DOCUMENTS

| | | |
|---|---|---|
| 0002453 | 6/1979 | European Pat. Off. . |
| 0086977 | 8/1986 | European Pat. Off. . |
| 2743768 | 4/1979 | Fed. Rep. of Germany . |
| 2754425 | 7/1979 | Fed. Rep. of Germany . |
| 2065982 | 7/1981 | United Kingdom . |

*Primary Examiner*—Bruce C. Anderson

*Attorney, Agent, or Firm*—Foley & Lardner, Schwartz, Jeffery, Schwaab, Mack, Blumenthal & Evans

[57] ABSTRACT

An apparatus to increase the adhesive properties of an electrode material embedded in a synthetic resin matrix of a conductive layer and also to improve the mechanical strength of the composite body comprising the synthetic resin matrix and the embedded electrode material, without giving rise to technical problems in the processing of the composite body into a roll electrode by a known winding process, is provided. Electrically conductive fibers are embedded in the electrically conductive layer and the roll electrode is formed of at least one electrically conductive layer of fiber-reinforced synthetic resins and at least one fiber-reinforced insulating layer of synthetic resins.

Roll electrodes of this type are used as counter-electrodes in corona devices for treating the surfaces of film webs by means of an electrical corona discharge, in order to improve the printability of the film webs or to increase the bond strength of the film webs with other layer materials.

20 Claims, 2 Drawing Sheets

ROLL ELECTRODE AND DEVICE FOR PRETREATING THE SURFACES OF FILM WEBS BY MEANS OF ELECTRICAL CORONA DISCHARGE

BACKGROUND OF THE INVENTION

The present invention relates to a roll electrode and a device for treating the surfaces of film webs by means of an electrical corona discharge. The roll electrode of the invention comprises an electrically conductive support roll and at least one dielectric layer applied to this support roll.

In the fields of converted plastic sheets and composite films, surface treatment by means of an electrical corona discharge is known in order to render the surface printable or to increase the bond strength of several layers. In this treatment, the plastic sheet or film is passed over an electrically grounded support surface, usually a roll, and the side of the film which faces away from the support surface is exposed to an electrical corona discharge which is generated by supplying high-frequency, high-voltage A.C. to an electrode arranged at a distance from the support surface. The known devices operating according to this basic principle differ only in the construction and the materials of the support surface serving as the counter-electrode (for example, an individual central roll with peripherally arranged electrodes or several electrode rolls with their respective electrodes), in the dielectric materials used to insulate the counter-electrode, in the design of the electrode used, and in the type of generator employed in each case.

As the simplest and thus the favored design of the roll electrode, metal support rolls comprised of a solid material, in particular, steel or aluminum rolls, coated with layers of insulating materials such as, for example, glass, ceramics, enamel, rubber, or glass fiber reinforced plastics, have gained general acceptance. This construction principle has the disadvantages that equipment costs are considerably increased since expensive steel rolls must be provided and that the roll weights are so high that, particularly in large-scale installations, technical problems arise in connection with the bearing, bending, true running and driving of the rolls. To overcome these problems, U.S. Pat. No. 4,239,973 and European Patent No. 0 086 977 describe corona devices which use hollow roll bodies comprising fiber-reinforced synthetic resin tubes. These fiber-reinforced tubular bodies, which have only a fraction of the weight of steel rolls, not only meet mechanical requirements, but naturally also act as the electrodes due to the wire winding embedded in the synthetic resin matrix. The manufacture of these glass fiber-reinforced roll bodies does not present any difficulty whatsoever; however, it appears that, upon embedding a wire winding or a wire helix into the synthetic resin matrix to render it electrically conductive, the interlaminar shear strength, that is, the adhesion between the synthetic resin matrix and metal wire, leaves much to be desired.

SUMMARY OF THE INVENTION

It is therefore an object of the present invention to improve the above-described roll electrode such that the composite body comprised of synthetic resin matrix and embedded electrode material can be processed into a roll electrode by a winding process without technical difficulties, the adhesive properties of the electrode material embedded in the synthetic resin matrix and, consequently, the interlaminar shear strength can be improved and the composite body of synthetic resin matrix and embedded electrode material will have an increased mechanical strength.

In accomplishing the foregoing objects, there has been provided according to the present invention a roll electrode for treating the surfaces of film webs with an electrical corona discharge, comprising an electrically conductive support roll comprising at least one electrically conductive layer comprised of fiber-reinforced synthetic resin; and a first insulating layer positioned radially outwardly with respect to the electrically conductive layer.

In a preferred embodiment, the insulating layer also comprises a fiber-reinforced synthetic resin.

In another aspect of the invention, the invention comprises an apparatus for treating the surfaces of film webs with an electrical corona discharge, comprising an electrode supplied with high frequency alternating current; and a grounded counter-electrode, positioned opposite the electrode, the counter-electrode comprising a roll electrode for treating the surfaces of film webs with an electrical corona discharge, comprising an electrically conductive support roll comprising at least one electrically conductive layer of fiber-reinforced synthetic resins; and an insulating layer positioned radially outwardly with respect to said electrically conductive layer.

Further objects, features and advantages of the present invention will become apparent from the detailed description of preferred embodiments which follows, when considered with the attached figures of drawings.

BRIEF DESCRIPTION OF DRAWINGS

The roll electrode according to the present invention is explained in detail with reference to the accompanying drawings.

DETAILED DESCRIPTION OF PREFERRED EMBODIMENTS

Figure 1:
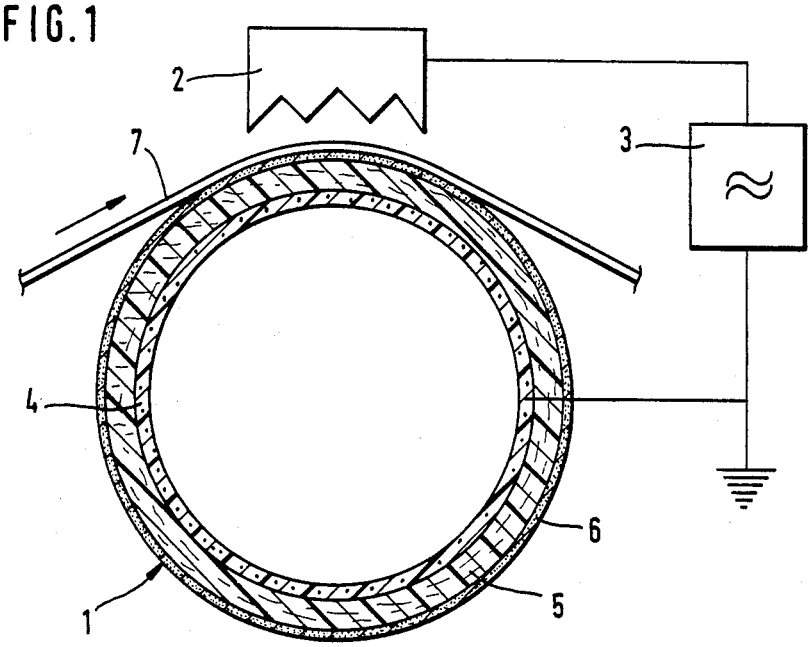
FIG. 1 is a diagrammatic cross-section of a first embodiment of a corona device equipped with a roll electrode a the counter-electrode.

According to the invention, the roll electrode is constructed to form a composite body comprising at least one electrically conductive layer of fiber-reinforced synthetic resins, the fibers of which are electrically conductive, and at least one insulating layer of fiber-reinforced synthetic resins, which is applied to the conductive layer.

In an embodiment of the invention, the fibers of the electrically conductive layer comprise carbon fibers. The fibers of the electrically conductive layer may also be glass, aramide or carbon fibers which have been rendered electrically conductive by metallizing.

Glass fibers are preferably embedded in the insulating layer. The electrically conductive layer is, moreover, sandwiched between two insulating layers.

In another embodiment of the invention, the roll electrode is built up by a winding process to form a multilayer composite body comprising alternating dielectric insulating layers and electrically conductive layers having the same or different thicknesses. The synthetic resins used for the electrically conductive layers and the insulating layers preferably comprise unsaturated polyester, epoxide, polyimide or silicone resins.

Metallizing various fibers with the aid of a currentless or a chemo-galvanic process is known in the art. By these processes, a metallic coating of nickel, cobalt, a nickel-cobalt alloy or an alloy of these metals with iron, e.g. nickel-iron, is applied to the fibers. It is also possible to deposit gold, silver, copper and other metals which are suitable for chemical deposition on the surfaces of synthetic fibers or semi-finished products or textile sheet materials comprising these fibers, after a corresponding activation thereof.

Electrical nonconductors and also conductive carbon fibers can be metallized according to various methods known in the prior art. In these methods, the fiber surface is, in general, activated with heavy metal catalysts. Following activation, the fiber material is introduced into a metal salt solution and the elementary metal is deposited in its purest possible form on the fiber surface by means of a chemical reducing agent (see U.S. Pat. No. 4,201,825).

After the metallizing step, the electrode materials can be processed without difficulty using the machines and manufacturing processes, e.g., the filament winding technique, which are generally employed in the production of composite materials. Apart from this advantage, the incorporation of high-strength fibers which are impregnated, for example, with the same synthetic resin used to prepare the synthetic resin matrix of the basic roll body, results in a final roll body having a composite structure of improved homogeneity and an increased mechanical strength, comparable to the mechanical strength of metals. The metal layers deposited on the fibers have an adhesive promoting effect on the system of fiber and resin component, which leads to an increased interlaminar shear strength and thus to an improved bond strength of the molded body.

Using the known winding techniques it is also possible to embed a compact electrode layer in the synthetic resin matrix. Attempts to form a compact conductive layer, for example, by winding metal bands, e.g. comprising an aluminum foil, between the insulating layers have hitherto failed due to the fact that the metal foil acted as a separating layer which impaired the bond strength between the inner and outer winding layers of the glass fiber reinforced roll body. This disadvantage is overcome by impregnating the metallized fiber rovings provided for forming the electrode layer with the resin used for the matrix.

As shown in FIG. 1, the device for corona treating film webs comprises a roll electrode 1 according to the present invention. Above the roll electrode 1, a metallic discharge electrode 2 is disposed which is connected to a high-voltage generator 3. When high-frequency, medium to high-voltage A.C. is supplied to the discharge electrode 2, the air gap between the roll electrode 1 and the discharge electrode 2 is ionized and a corona discharge is produced. A film web 7 which is conveyed over the roll electrode 1 undergoes corresponding physical-chemical changes on its surface when it passes through the discharge zone and, as a result, the printability of the film or its bond strength towards layer materials is improved.

The roll electrode 1 depicted in FIG. 1 comprises an inner, electrically conductive, compact layer 4 acting as the electrode layer, a superposed insulating layer 5 of a glass fiber-reinforced material and an outer protective layer 6 comprising a silicone varnish. Metallized glass, aramide or carbon fibers which are embedded in a matrix of epoxide, silicone, unsaturated polyester or polyimide resins can be used to form the electrically conductive electrode layer 4. If carbon fibers are used which possess an adequate electrical conductivity, metallizing may, from case to case, be dispensed with. As is known from experience, metallic layer thicknesses of less than 1 mm, preferably of about 0.5 mm, entirely meet the electrical conductivity requirements of metallized fibers.

The insulating layer 5 comprises an about 2.5 to 3.5 mm thick layer of glass fibers which, similar to the electrode layer 4, are embedded in a matrix formed of epoxide, silicone, unsaturated polyester or polyimide resins.

The silicone varnish-based protective layer 6 which is only a few $\mu$m thick prevents abrasion and thus destruction of the insulating layer 5 by the corona discharge.

Figure 2:
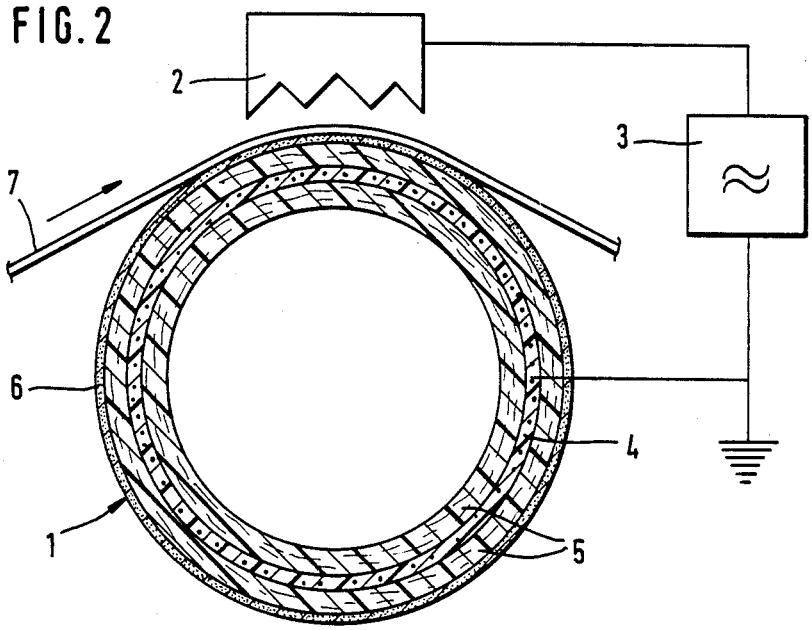
FIG. 2 is a diagrammatic cross-section of a second embodiment of a corona device equipped with a roll electrode as the counter-electrode.

The embodiment of the roll electrode 1 according to FIG. 2 differs from the roll electrode of FIG. 1 in that the electrode layer 4 is sandwiched between two insulating layers 5, namely an inner support layer and an outer dielectric layer. This embodiment permits different configurations of the electrode layer 4, as will be explained with reference to FIGS. 3, 4 and 5. The inner insulating layer 5 exclusively acts as a support for the electrode layer 4. This roll construction has the advantage that the electrode layer 4, which is formed of an expensive material, comprises a winding which is only as thick as necessitated by electrical requirements, irrespective of its mechanical strength properties, whereas mechanical strength, in general, is the only criterion for the construction of the inner support layer. Since the resin components of the two insulating layers 5,5 and of the electrode layer 4 are identical, there are no problems with regard to the interlaminar bond strength between the individual layers.

A winding process may also be used to form a multilayer roll comprising alternating electrically conductive and electrically insulating layers of the same or different thicknesses, which multi-layer roll has the shape and the action of an electrical capacitor. The capacity of a roll body of this type can be adjusted as required, via the respective layer thicknesses of the individual layers.

Figure 3:
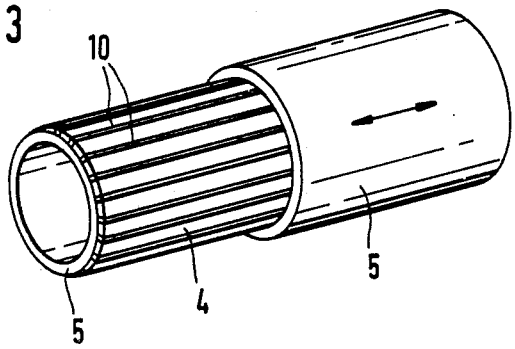
FIG. 3 is a perspective view of a different form of electrodes which are embedded in the synthetic resin matrix of the roll electrode.

In FIG. 3, the electrically conductive layer 4 has the shape of a tube and has a fiber arrangement 10 which is directed parallel to the tube axis and is embedded in the synthetic resin matrix. The electrically conductive layer 4 forms a tube-shaped, homogeneous, compact layer enclosed by insulating layers 5 arranged on either side thereof.

Figure 4:
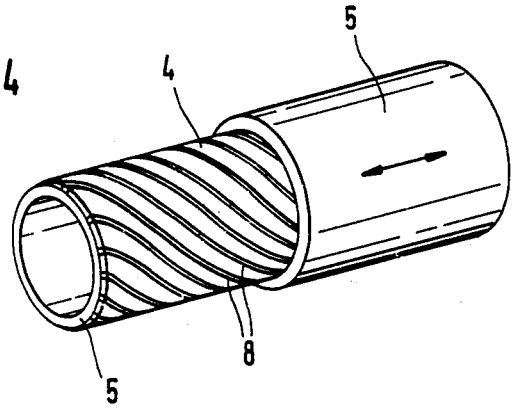
FIG. 4 is a perspective view of a different form of electrodes which are embedded in the synthetic resin matrix of the roll electrode.

In the embodiment according to FIG. 4, the fibers are embedded, as a single or multiple helix 8, in the electrically conductive layer 4 which has the form of a homogeneous, compact tube, as shown in FIG. 3.

Figure 5:
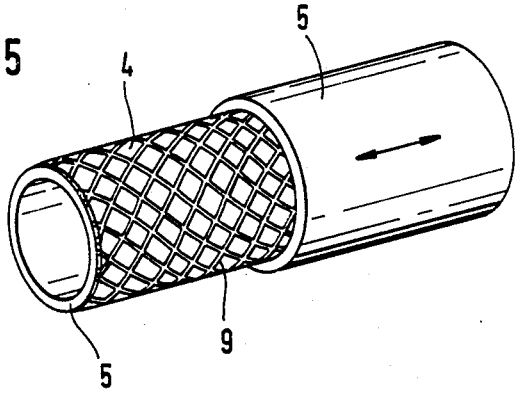
FIG. 5 is a perspective view of a different form of electrodes which are embedded in the synthetic resin matrix of the roll electrode.

FIG. 5 shows a further embodiment of the electrically conductive layer 4, in which the fibers form a network 9 in the synthetic resin matrix of the conductive layer 4 which has the form of a homogeneous, compact tube.

It is to be understood that the metallized fibers, the carbon fibers without metallizing treatment which are present in the electrically conductive layer 4 and the semi-finished products or sheet-like materials comprising these fibers may be incorporated in the synthetic resin matrix in any shape, such as, for example, in loose arrangements, as woven fabrics, knitted fabrics, nonwovens etc. The embodiments shown in FIGS. 3 to 5 are examples of the great number of fiber arrangement which are possible in the synthetic resin matrix.

The advantages resulting from an improved bond strength of the metallized fiber arrangements are achieved by the electrode configurations according to FIGS. 3, 4 and 5 and also by electrode configurations comprising other woven or knitted fiber fabrics which do not have a homogeneous "separating layer" (not shown). A further advantage of the electrode forms shown in FIGS. 3, 4 and 5 is that roll bodies constructed in this way can be provided with perforations and can thus be used together with vacuum rolls, in a manner described in connection with the corona device described in European Patent No. 0 086 977.

What is claimed is:

1. A roll electrode for treating the surface of a film web with an electrical corona discharge, comprising:
   an electrically conductive support roll comprising at least one electrically conductive layer comprised of fiber-reinforced synthetic resin the fibers of which are electrically conductive; and
   a first insulating layer positioned radially outwardly with respect to said electrically conductive layer.

2. A roll electrode as claimed in claim 1, wherein the insulating layer comprises a fiber-reinforced synthetic resin.

3. A roll electrode as claimed in claim 2, wherein the fibers in the insulating layer comprise glass fibers.

4. A roll electrode as claimed in claim 1 wherein the fibers of the electrically conductive layer comprise electrically conductive glass fibers.

5. A roll electrode as claimed in claim 1 wherein the fibers of the electrically conductive layer comprise electrically conductive aramide fibers.

6. A roll electrode as claimed in claim 1, wherein the fibers of the electrically conductive layer comprise electrically conductive carbon fibers.

7. A roll electrode as claimed in claim 1, further comprising a second insulating layer, the electrically conductive layer being sandwiched between the first and second insulating layers.

8. A roll electrode as claimed in claim 1, wherein the electrically conducting layer and the insulating layer are wound on the roll electrode.

9. A roll electrode as claimed in claim 1, wherein the synthetic resins in the electrically conductive layer and the insulating layer comprise an unsaturated polyester.

10. A roll electrode as claimed in claim 1, wherein the synthetic resins in the electrically conductive layer and the insulating layer comprise an epoxide.

11. A roll electrode as claimed in claim 1, wherein the synthetic resins in the electrically conductive layer and insulating layer comprise a polyimide.

12. A roll electrode as claimed in claim 1, wherein the synthetic resins in the electrically conductive layer and insulating layer comprise a silicone resin.

13. A roll electrode as claimed in claim 1, further comprising a silicone resin layer applied to the outer peripheral surface of the roll electrode to protect it from the abrasive effects of a corona discharge.

14. A roll electrode as claimed in claim 1 wherein the fibers of the electrically conductive layer are incorporated in the synthetic resins in a random arrangement.

15. A roll electrode as claimed in claim 1 wherein the fibers of the electrically conductive layer are incorporated in the synthetic resins in the form of a woven fabric.

16. A roll electrode as claimed in claim 1, wherein the fibers of the electrically conductive layer are incorporated in the synthetic resins in the form of a knitted fabric.

17. A roll electrode as claimed in claim 1, wherein the electrically conductive layer is formed as a homogeneous, compact layer in a helix arrangement and is formed in the shape of a tube.

18. A roll electrode as claimed in claim 1, wherein the electrically conductive layer is formed as a homogeneous, compact layer in the pattern of intersecting helixes and is formed in the shape of a tube.

19. A roll electrode as claimed in claim 1, wherein the electrically conductive layer is formed as a homogeneous, compact layer in a pattern of segments extending in the axial direction of the tube.

20. An apparatus for treating the surface of a film web with an electrical corona discharge, comprising:
   an electrode supplied with high frequency alternating current; and
   a grounded counter-electrode positioned opposite said electrode, the counter-electrode comprising a roll electrode for treating the surface of a film web with an electrical corona discharge, comprising:
   an electrically conductive support roll comprising at least one electrically conductive layer comprised of fiber-reinforced synthetic resin the fibers of which are electrically conductive; and
   an insulating layer positioned radially outwardly with respect to said electrically conductive layer.

* * * * *